US008424310B2

(12) United States Patent
Syed

(10) Patent No.: US 8,424,310 B2
(45) Date of Patent: Apr. 23, 2013

(54) MIXING CHAMBER

(75) Inventor: Khawar Syed, Woodhall Spa (GB)

(73) Assignee: Siemens Aktiengesellschaft, München (DE)

( * ) Notice: Subject to any disclaimer, the term of this patent is extended or adjusted under 35 U.S.C. 154(b) by 953 days.

(21) Appl. No.: 12/386,834

(22) Filed: Apr. 23, 2009

(65) Prior Publication Data

US 2009/0266077 A1 Oct. 29, 2009

(30) Foreign Application Priority Data

Apr. 23, 2008 (EP) ..... 08007874

(51) Int. Cl.
*F02C 1/00* (2006.01)
*F02G 3/00* (2006.01)
*B05B 7/10* (2006.01)

(52) U.S. Cl.
USPC ..... 60/737; 60/748; 239/419; 239/399; 431/183

(58) Field of Classification Search ..... 60/737, 60/748; 239/419, 399; 431/183
See application file for complete search history.

(56) References Cited

U.S. PATENT DOCUMENTS

| | | | | | |
|---|---|---|---|---|---|
| 2,958,195 | A | * | 11/1960 | Dooley | 60/748 |
| 3,811,278 | A | * | 5/1974 | Taylor et al. | 60/743 |
| 4,363,208 | A | * | 12/1982 | Hoffman et al. | 60/800 |
| 4,619,580 | A | * | 10/1986 | Snyder | 415/12 |
| 5,165,241 | A | * | 11/1992 | Joshi et al. | 60/737 |
| 5,351,477 | A | * | 10/1994 | Joshi et al. | 60/39.463 |
| 5,433,596 | A | * | 7/1995 | Dobbeling et al. | 431/350 |
| 5,558,515 | A | * | 9/1996 | Althaus et al. | 431/284 |
| 5,613,363 | A | * | 3/1997 | Joshi et al. | 60/737 |
| 5,636,510 | A | * | 6/1997 | Beer et al. | 60/39.23 |
| 5,658,358 | A | * | 8/1997 | Chyou et al. | 48/180.1 |
| 6,151,899 | A | * | 11/2000 | Park | 60/748 |
| 6,311,496 | B1 | * | 11/2001 | Alkabie | 60/748 |
| 6,532,726 | B2 | * | 3/2003 | Norster et al. | 60/39.281 |
| 6,834,505 | B2 | * | 12/2004 | Al-Roub et al. | 60/737 |
| 6,993,916 | B2 | * | 2/2006 | Johnson et al. | 60/776 |
| 7,565,803 | B2 | * | 7/2009 | Li et al. | 60/748 |

FOREIGN PATENT DOCUMENTS

| | | | |
|---|---|---|---|
| DE | 44 17 538 | A1 | 11/1995 |
| EP | 0 619 456 | A1 | 10/1994 |
| EP | 0 675 322 | A2 | 10/1995 |
| EP | 0 718 558 | A2 | 6/1996 |
| EP | 0 718 561 | A2 | 6/1996 |
| EP | 0 733 861 | A2 | 9/1996 |
| EP | 0 745 809 | A1 | 12/1996 |
| GB | 2 288 010 | A | 10/1995 |
| WO | WO 2007/013818 | A1 | 11/2007 |

* cited by examiner

*Primary Examiner* — Ehud Gartenberg
*Assistant Examiner* — Michael B Mantyla

(57) ABSTRACT

A mixing chamber with a wall and at least one vortex generating element arranged on the wall is provided. The vortex generating element has at least three surfaces, at least one of the surfaces forming a top surface and the other surfaces forming at least first and second side surfaces, the first and second side surfaces arranged not in parallel, the top surface being in contact with the wall via a front edge of the top surface, the front edge extending traverse to a flow direction, the top surface further abutting the first and second side faces forming first and second edges, the first side surface extending in parallel to the flow direction so that the first edge does not contribute to generating a vortex, and the second side surface extending not in parallel to the flow direction so that the second edge contributes to generating the vortex.

19 Claims, 5 Drawing Sheets

MIXING CHAMBER

CROSS REFERENCE TO RELATED APPLICATIONS

This application claims priority of European Patent Office application No. 08007874.4 EP filed Apr. 23, 2008, which is incorporated by reference herein in its entirety.

FIELD OF THE INVENTION

The invention relates to lean premixed combustors with a high swirl.

BACKGROUND OF THE INVENTION

Lean premixed combustors rely on a high degree of swirl to both promote fuel air mixing and to provide a reverse flow zone to stabilize the combustion.

Certain designs of lean premixed burners are capable of operating with a very high swirl. In such burners, a very high swirl results in very firm and robust aerodynamics which in turn promotes stable combustion and minimises issues with combustion dynamics. From a combustion perspective high swirl is therefore advantageous.

Though being good for the combustion system, a very high swirl can be damaging for the turbine, as a highly rotating vortex core can be produced in the downstream part of the combustor. On encountering the turbine, the vortex core leads to a reduction in aerodynamic performance of the turbine, and more significantly increases the heat loading on the turbine components through enhancing the heat transfer.

Present gas turbines deal with this problem by either having lower swirl for the burner, thereby reducing the robustness against flame dynamics, or increasing the robustness of the turbine to be able to deal with a highly rotating vortex core. In the case of the latter, there is additional cost due to the use of greater turbine cooling air flows, increased turbine material cost, reduced turbine life, and reduced turbine aerodynamic performance.

WO 20071096294 A1 and WO 2007/131818 A1 describe swirlers for use in a burner of a gas turbine engine, the swirlers comprising a plurality of vanes arranged in a circle, flow slots being defined between adjacent vanes in the circle, each flow slot having an inlet end and an outlet end, in use of the swirler a flow of fuel and air travelling along each flow slot from its inlet end to its outlet end such that the swirler provides a swirling mix of the fuel and air.

SUMMARY OF THE INVENTION

An object of the invention is to provide an improved mixing chamber for high swirl burner. A further object of the invention is to provide an improved combustion apparatus.

These objects are achieved by the claims. The dependent claims describe advantageous developments and modifications of the invention.

An inventive mixing chamber comprises a wall, at least one vortex generating element arranged on the wall, the at least one vortex generating element having at least three surfaces, at least one of the surfaces forming a top surface and the other surfaces forming at least first and second side surfaces, the first and second side surfaces arranged not in parallel, the top surface being in contact with the wall via a front edge of the top surface, the front edge extending traverse to a flow direction, the top surface further abutting the first and second side faces forming first and second edges, the first side surface extending in parallel to the flow direction so that the first edge does not contribute to generating a vortex, and the second side surface extending not in parallel to the flow direction so that the second edge contributes to generating the vortex.

The vortex generating elements are arranged to interact with the streamlines of the flow that are close to the stagnation streamline bounding a central recirculation zone. They thus introduce counter rotation to stream tubes closest to the central recirculation zone and a downstream vortex core.

The first side being in parallel to the flow direction does not therefore generate a vortex. If it did, the vortex would be co-rotating with the main flow and would therefore lead to a strengthening of the vortex core. Given that the streamlines of the flow are curved, there would be an advantage in curving this surface to match. However, if the vortex generating elements are relatively short with respect to the radius of curvature of the streamlines, a straight surface will not be too detrimental. This surface could also be angled to the flow in order to induce some degree of co-rotation, as, providing this is smaller than the counter rotation from the main vortex generating element surface, enhanced mixing, as well as a reduction in the strength of the vortex core can be achieved.

It is advantageous when the first and second side faces include a connecting edge connecting first and second side faces, so that the vortex generating elements are tetrahedral shaped objects, the connecting edge preferably extending perpendicular relative to the wall.

Preferably the second edge is configured to be essentially sharp, so that the vortex generating element has a single vortex generating surface, which creates a vortex in the same way as a delta wing does.

In an advantageous embodiment the connecting edge forms a downstream edge of the vortex generating element and the front edge of the top surface is an edge which a main flow approaches first relative to the flow direction.

Preferably, the mixing chamber has a tubular shape and the vortex generating elements are arranged on a common radial.

In another advantageous embodiment fuel injection openings are arranged on the vortex generating elements. The fuel could be either liquid or gas. Though the main premixing fuel should be injected elsewhere, the vortex generating elements can serve as injectors for pilot fuel, as this fuel, which enriches the inner recirculation zone with fuel, would promote flame stability at low loads.

Preferably the wall on which the vortex generating elements are arranged is a back face of a burner.

It is advantageous when the vortex generating elements are arranged outside, but close to a region where a central reverse flow zone is anchored during operation of the mixing chamber. The vortex generating elements are then outside the region where hot combustion products are recirculated and will not therefore suffer from overheating problems.

In another advantageous embodiment the vortex generating elements consist of a different material compared to the wall to which they are attached. Preferably this material is a sintered high temperature machining tool material. In another preferable embodiment the material is a sprayed-on ceramic. The advantage is that if the risk of oxidation is reduced, the vortex generating elements can move closer to the centre and thereby could generate stronger counteracting vortices.

In an advantageous combustion apparatus a flow direction is determined by a swirler arranged upstream of the mixing chamber.

Preferably the swirler comprises a plurality of vanes arranged on a first circle, and flow slots being defined between adjacent vanes and arranged tangential relative to a second circle defined by radially inner ends of the vanes.

The vanes of the swirler are preferably shaped as wedges.

Such a design of the vortex generating elements introduces counter rotation that is targeted at the region of concern, i.e. the vortex core region. This allows the vortex core to have a reduced swirl downstream of the internal reverse flow zone, whilst still maintaining a high overall swirl. A high overall swirl reduces problems associated with combustion dynamics. The present invention allows the vortex core to be targeted with measures to reduce its swirl, without harming any of the positive features of a high swirl combustor.

BRIEF DESCRIPTION OF THE DRAWINGS

The invention will now be further described with reference to the accompanying drawings in which.

DETAILED DESCRIPTION OF THE INVENTION

Figure 1:
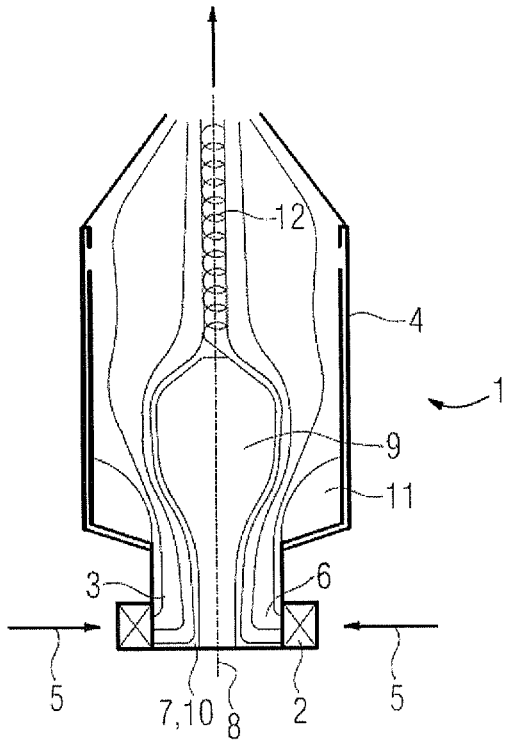
FIG. 1 represents a sketch of a lean premixed gas turbine combustor showing major flow features.

FIG. 1 is a sketch of a lean premixed gas turbine combustor 1 with swirler 2, mixing chamber 3 and main combustion chamber 4, showing major flow features. The main combustion air 5 enters through a single radial swirler 2 at the head of the combustor 6. The flow then turns through a right angle into the mixing chamber 3 followed by a sudden expansion into the combustion chamber 4. The swirl number is sufficiently high to induce a vortex breakdown reverse flow zone along the axis 8 of the combustor. This is termed the internal reverse flow zone 9. The internal reverse flow zone 9 remains attached to the back surface of the combustor, which is the back face 7 of the burner, thereby establishing a firm aerodynamic base for flame stabilisation. In the wake of the sudden expansion, an external reverse flow zone 11 is established. The flame is stabilised in the shear layers around the internal and external reverse flow zones 9,11. A highly rotating vortex core 12 is indicated along the axis 8 of the combustor 1 and directing to the turbine.

Figure 2:
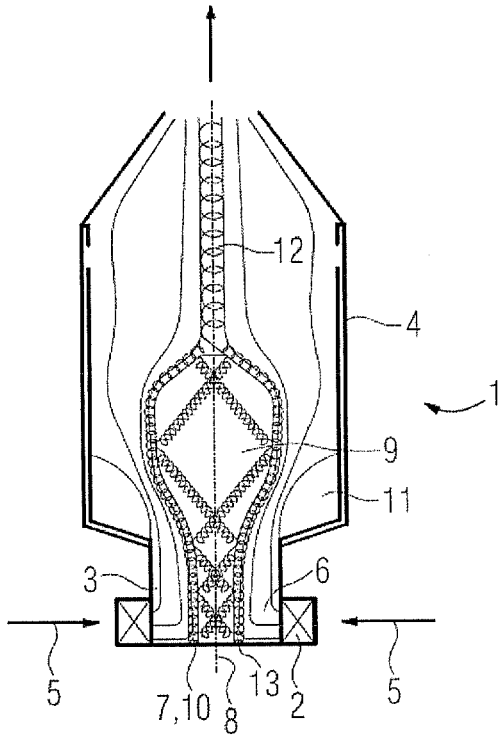
FIG. 2 is a sketch of a lean premixed combustor with vortex generating elements.

FIG. 2 shows the sketch of a lean premixed gas turbine combustor 1 with flow generating elements 13 arranged on the back face 7 of the burner, outside but close to the region where the internal reverse flow zone 9 is anchored. FIG. 2 further shows the contra-rotation from vortex generating elements 13 reducing rotation and vorticity in the core 12.

Figure 3:
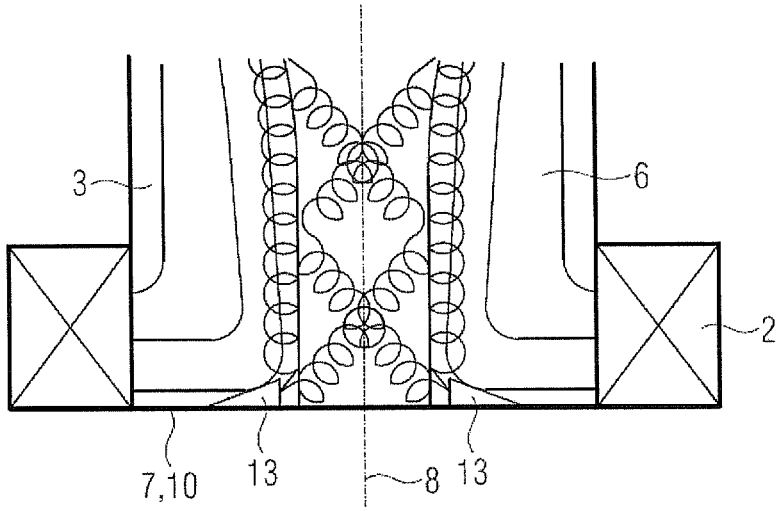
FIG. 3 shows a close up of the region where the vortex generating elements are implemented.

FIG. 3 shows a close-up view of the vortex generating elements 13 arranged on the back face 7 of the burner, the swirler 2 and the streamlines of air and fuel.

Figure 4:
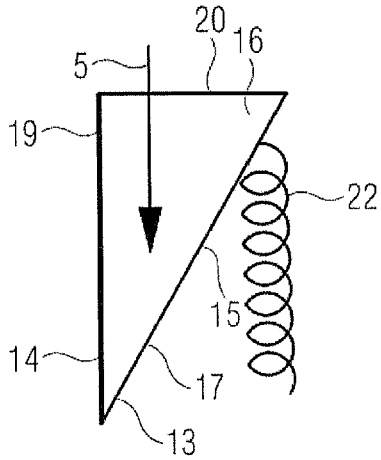
FIG. 4 represents a top view of a vortex generating element with an arrow indicating the direction of the main flow.

FIGS. 4 to 7 show different views onto a vortex generating element 13. FIG. 4 represents a top view of a vortex generating element 13 with an arrow indicating the direction of the main flow 5 first approaching the front edge 20 of the top surface 16. A first side surface 14 is in parallel to the flow direction 5 and may be curved to better align with the streamlines so that no vortex will be generated at the first edge 19 between top surface 16 and first side surface 14. A vortex 22 is generated at the second edge 15 between the top surface 16 and the second side surface 17.

Figure 5:
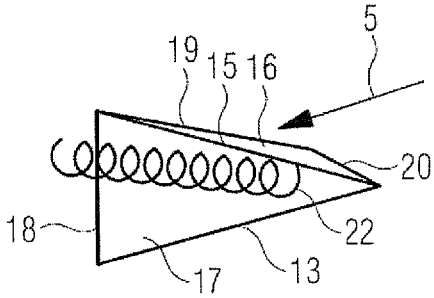
FIG. 5 represents a perspective view of a vortex generating element.

FIG. 5 represents a perspective view of a vortex generating element 13 showing its tetrahedral shape. The first and second side surfaces 14,17 include a connecting edge 18 connecting first and second side faces 14,17. The second edge 15 of the top surface 16 abutting the second side surfaces 17 is configured to be essentially sharp. The connecting edge 18 forms a downstream edge of the vortex generating element 13 and the front edge 20 of the top surface 16 is an edge which a main flow 5 approaches first.

Figure 6:
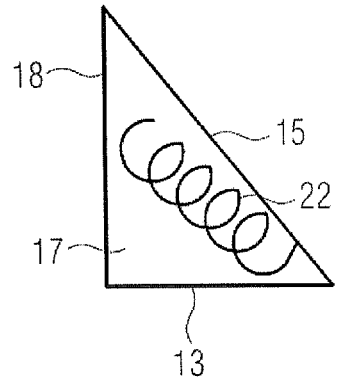
FIG. 6 represents a rear view of a vortex generating element.

FIG. 6 represents a rear view of a vortex generating element 13 and shows the second side surface 17 with a vortex 22 generated at the second edge 15 between top surface 16 and second side surface 17.

Figure 7:
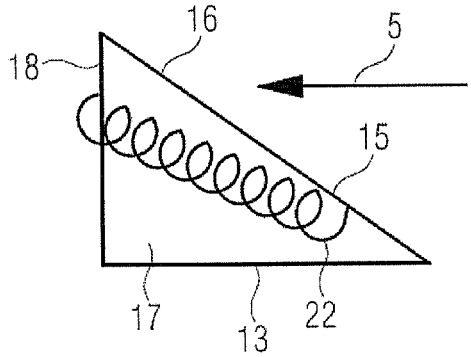
FIG. 7 represents a side view of a vortex generating element.

FIG. 7 represents a side view of a vortex generating element 13. Again, the second side surface 17 is shown.

Figure 8:
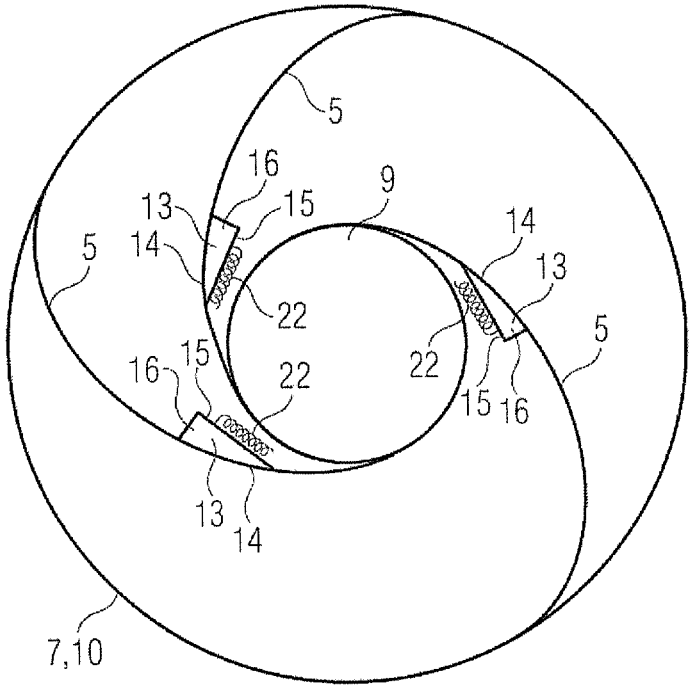
FIG. 8 shows an arrangement of vortex generating elements on the back face of a burner.

Referring to FIG. 8 an arrangement of vortex generating elements 13 on the back face 7 of a burner is shown. Any number of vortex generating elements 13 can be arranged on the burner face 7 outside but close to the region where the internal reverse flow zone 9 is anchored. FIG. 8 shows examples of streamlines 5 over the burner face 7. The first side surfaces 14 can be curved to better align with the streamlines. Vortices 22 are generated at second edges 15 between top surface 16 and second side surface 17.

Figure 9:
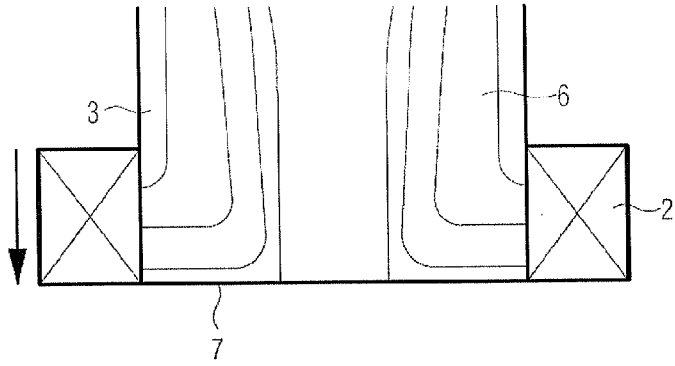
FIGS. 9 and 9*a* show an alternative solution where the rotation of the vortex core is reduced by altering the geometry of the main swirler.
Figure 9A:
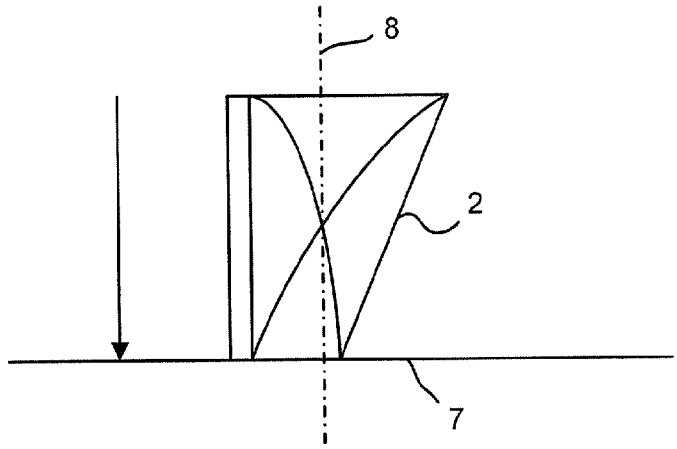

As an alternative to the vortex generating elements 13 the swirl in the vortex core 12 could also be reduced through modification of the swirler 2. For example, the swirler angle could be reduced along the height of the swirler 2, as the back face 7 of the burner is approached, as shown in FIG. 9. The swirler of FIG. 9 can be seen in FIG. 9A in a view looking radially inward. It can be seen that as the swirler 2 approaches the back face 7, the swirler angle with respect to the burner central axis 8 decreases.

Figure 10:
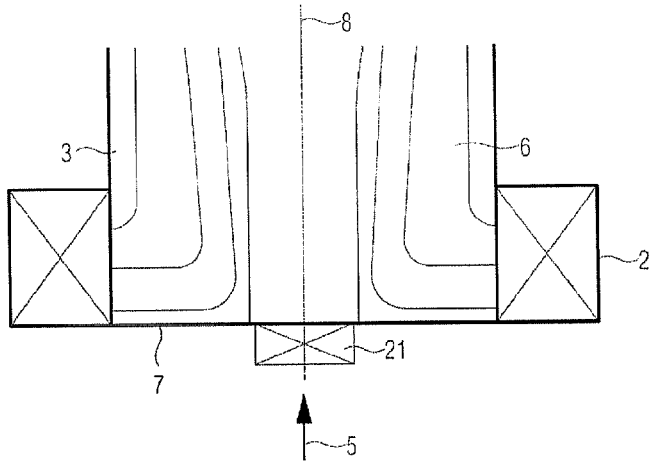
FIG. 10 shows a counter swirler at the base of the reverse flow zone.
Figure 11:
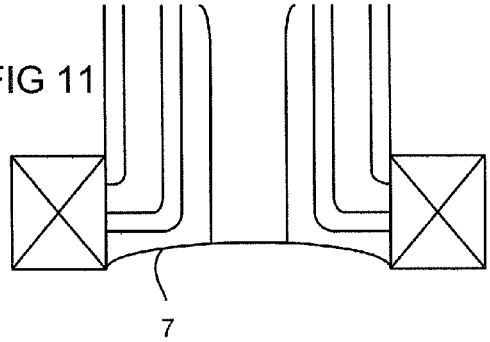
FIGS. 11, 12, 13, and 14 show various geometries for the back face of the burner. In the drawings like references identify like or equivalent parts.
Figure 12:
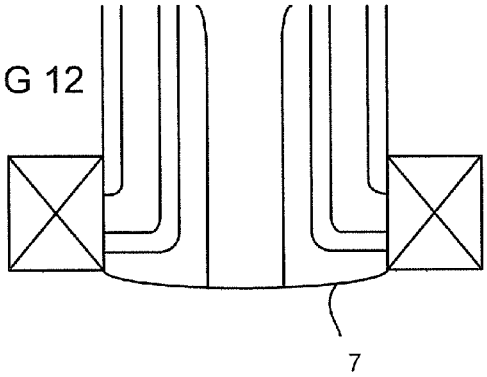
Figure 13:
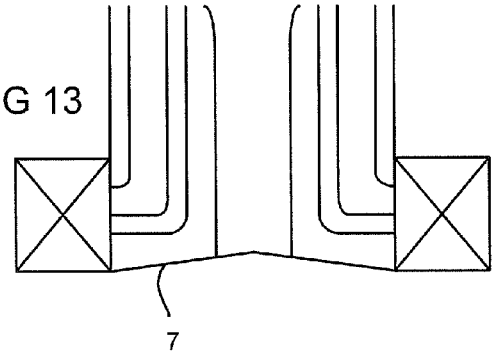
Figure 14:
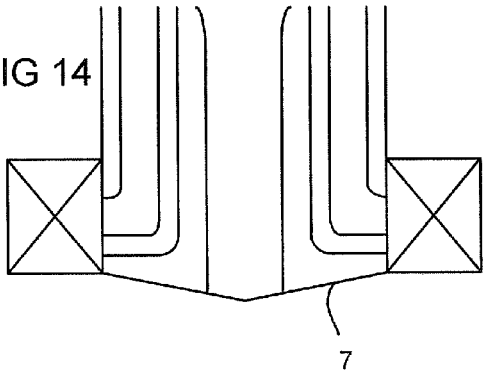

As another alternative, the vortex core 12 could also be targeted by introducing features at the back face of the burner 7, within the internal reverse flow zone 9, such as a counter swirler 21 at the base of the internal reverse flow zone 12 as shown in FIG. 10.

The back face 7 of the burner is shown as straight in the figures. However the application of this invention is not limited to a straight burner back face. The face could be curved, or angled, both towards the combustor or away from the combustor as shown in FIGS. 11 through 14.

What is claimed is:

1. A mixing chamber, comprising:

a wall; and a vortex generating element arranged on the wall, the vortex generating element comprising:

a top surface, a first side surface, and a second side surface, wherein the first side surface and the second side surface are not arranged in parallel, wherein the top surface is in contact with the wall via a front edge of the top surface, the front edge extending traverse to a flow direction, wherein the top surface abuts the first side surface and the second side surface forming a first edge and a second edge, wherein the first side surface extends in parallel to the flow direction so that the first edge does not contribute to generating a vortex, wherein the second side surface does not extend in parallel to the flow direction so that the second edge contributes to generating the vortex, wherein the vortex generating elements are effective to generate vortices in a previously swirled flow passing therethrough, and wherein the vortices are effective to induce counter rotation in a region within the swirled flow.

2. The mixing chamber as claimed in claim 1, wherein the first side surface and the second side surface include a connecting edge connecting the first side surface and the second side surface, the connecting edge extending substantially perpendicular relative to the wall, and wherein the vortex generating element is a tetrahedral-shaped object.

3. The mixing chamber as claimed in claim 2, wherein the connecting edge forms a downstream edge of the vortex generating element, and the front edge of the top surface is an edge where a main flow first approaches relative to the flow direction.

4. The mixing chamber as claimed in claim 1, wherein the second edge is essentially sharp.

5. The mixing chamber as claimed in claim 1, wherein the mixing chamber has a tubular shape.

6. The mixing chamber as claimed in claim 1, wherein a plurality of vortex generating elements are arranged on the wall on a common radial.

7. The mixing chamber as claimed in claim 1, wherein a fuel injection opening is arranged on the vortex generating element.

8. The mixing chamber as claimed in claim 1, wherein the wall is a back face of a burner.

9. The mixing chamber as claimed in claim 8, wherein the vortex generating element is arranged outside of a central reverse flow zone, but close to a region where the central reverse flow zone is anchored during an operation of the mixing chamber.

10. The mixing chamber as claimed in claim 1, wherein the vortex generating element consists of a first material and the wall to which the vortex generating element is attached consists of a second material, and wherein the first material and the second material are different.

11. The mixing chamber as claimed in claim 10, wherein the first material is a sintered high temperature machining tool material.

12. The mixing chamber as claimed in claim 10, wherein the first material is a sprayed-on ceramic.

13. A combustion apparatus comprising:

a mixing chamber which comprises:

a wall, and a vortex generating element arranged on the wall, comprising:

a top surface, a first side surface, and a second side surface; and a swirler disposed upstream of the vortex generating element and effective to induce a swirl in a flow entering the mixing chamber, wherein the first side surface and the second side surface are not arranged in parallel, wherein the top surface is in contact with the wall via a front edge of the top surface, the front edge extending traverse to a flow direction, wherein the top surface abuts the first side surface and the second side surface forming a first edge and a second edge, wherein the first side surface extends in parallel to the flow direction so that the first edge does not contribute to generating a vortex, wherein the second side surface does not extend in parallel to the flow direction so that the second edge contributes to generating the vortex, wherein a flow direction is determined by the swirler arranged upstream of the mixing chamber, wherein the vortex generating elements are effective to generate vortices in the swirled flow passing therethrough, and wherein the vortices are effective to induce counter rotation in a region within the swirled flow closest to a central recirculation zone located downstream of the vortex generating elements.

14. The combustion apparatus as claimed in claim 13, wherein the swirler comprises a plurality of vanes arranged on a first circle, and a plurality of flow slots being defined between adjacent vanes and arranged tangentially relative to a second circle defined by a plurality of radially inner ends of the vanes.

15. The combustion apparatus as claimed in claim 14, wherein the plurality of vanes are wedge-shaped.

16. The combustion apparatus as claimed in claim 13, wherein a swirler angle of the swirler with respect to a central axis of the burner is reduced along a height of the swirler as a back surface of a burner is approached.

17. The combustion apparatus as claimed in claim 13, wherein a counter swirler is arranged at the back surface of the burner at a base of an internal reverse flow zone.

18. The combustion apparatus as claimed in claim 13, wherein the back surface of the burner is curved, and wherein the back surface is curved towards the burner or away from the burner.

19. The combustion apparatus as claimed in claim 13, wherein the back surface of the burner is angled, and wherein the back surface is angle towards the burner or away from the burner.

* * * * *